US007900613B2

(12) United States Patent
Heuermann

(10) Patent No.: US 7,900,613 B2
(45) Date of Patent: Mar. 8, 2011

(54) HIGH-FREQUENCY IGNITION SYSTEM FOR MOTOR VEHICLES

(75) Inventor: Holger Heuermann, Stolberg-Breinig (DE)

(73) Assignee: Fachhochschule Aachen, Aachen (DE)

( * ) Notice: Subject to any disclaimer, the term of this patent is extended or adjusted under 35 U.S.C. 154(b) by 159 days.

(21) Appl. No.: 12/085,561

(22) PCT Filed: Feb. 5, 2007

(86) PCT No.: PCT/DE2007/000223

§ 371 (c)(1), (2), (4) Date: Aug. 18, 2008

(87) PCT Pub. No.: WO2007/090380

PCT Pub. Date: Aug. 16, 2007

(65) Prior Publication Data

US 2009/0165763 A1 Jul. 2, 2009

(30) Foreign Application Priority Data

Feb. 7, 2006 (DE) ..... 10 2006 005 792

(51) Int. Cl.
*F02P 3/01* (2006.01)
*F02P 3/04* (2006.01)

(52) U.S. Cl. ..... 123/606

(58) Field of Classification Search ..... 123/606, 123/607, 608, 598, 628; 315/209 R, 212, 315/209 CD; 361/256
See application file for complete search history.

(56) References Cited

U.S. PATENT DOCUMENTS

| | | | | | |
|---|---|---|---|---|---|
| 3,443,555 | A | * | 5/1969 | Gove | 123/606 |
| 3,934,566 | A | | 1/1976 | Ward | |
| 4,138,980 | A | | 2/1979 | Ward | |
| 4,230,448 | A | * | 10/1980 | Ward et al. | 431/208 |
| 4,446,826 | A | * | 5/1984 | Kimura et al. | 123/143 B |
| 4,686,953 | A | * | 8/1987 | Brown | 123/606 |
| 4,686,954 | A | * | 8/1987 | Brown | 123/607 |
| 5,429,103 | A | * | 7/1995 | Rich | 123/598 |

FOREIGN PATENT DOCUMENTS

| | | | |
|---|---|---|---|
| DE | 25 35 960 | A1 | 2/1976 |
| DE | 25 43 125 | A1 | 4/1977 |
| DE | 26 46 446 | A1 | 4/1977 |
| DE | 31 29 954 | C2 | 3/1982 |
| DE | 196 38 787 | A1 | 4/1998 |
| DE | 197 23 784 | C1 | 8/1998 |
| DE | 198 02 745 | A1 | 7/1999 |
| DE | 100 61 672 | A1 | 6/2002 |
| DE | 102 43 271 | A1 | 12/2003 |
| DE | 600 26 841 | T2 | 11/2006 |
| EP | 0 055 871 | B1 | 7/1982 |

(Continued)

*Primary Examiner* — Mahmoud Gimie
(74) *Attorney, Agent, or Firm* — Birch, Stewart, Kolasch & Birch, LLP

(57) ABSTRACT

A high-frequency ignition system for spark ignition engines has a large ignition range with a cover measuring up to a plurality of square centimeters and enables the optional adjustment of the duration of the ignition. The combustion time can be minimized as a result of the large ignition range. Excellent degrees of efficacy can be obtained with this ignition using dielectric electrodes. The high-frequency ignition system can be very economically produced by means of high-frequency electronic components which are available at a very low cost as a result of the telecommunication market, and by means of standard spark plug technology. The high-voltage requirements are also significantly lower compared to classic ignition systems.

15 Claims, 7 Drawing Sheets

FOREIGN PATENT DOCUMENTS

| | | | |
|---|---|---|---|
| EP | 0 749 871 | A2 | 12/1996 |
| EP | 0 913 897 | A1 | 5/1999 |
| EP | 1 088 701 | A1 | 4/2001 |
| FR | 2 833 660 | A1 | 6/2003 |
| GB | 616547 | A | 1/1949 |
| WO | WO-99/37911 | A1 | 7/1999 |
| WO | WO-03/042533 | A1 | 5/2003 |

* cited by examiner $HE_{11}$ - Mode $E_{01}$ - Mode $\varepsilon_1 = 81\,\varepsilon_0$ $\varepsilon_2 = \varepsilon_0$ $\lambda = 14{,}4a > \lambda_c = 23{,}6a$

HIGH-FREQUENCY IGNITION SYSTEM FOR MOTOR VEHICLES

BACKGROUND OF THE INVENTION

The purpose of an ignition system is to ignite the compressed air/fuel mixture in proper time to thereby initiate the combustion process.

Though ignition systems used in the motor vehicle field have been strongly modified in a great many details over the past century, the basic principle has remained unchanged like that for the two most important engine concepts (gasoline and diesel engine). In case of the gasoline engine there is a high voltage of more than 25000 V generated which when applied to a spark plug causes a short-time arc discharge between electrode and ground.

While prior ignition systems comprised mechanical switches only it is customary practice today to use electronic transistor switches almost exclusively. Even though just one ignition coil and just one ignition distributor have been used conventionally, it becomes more and more customary to employ one ignition coil for each cylinder. Meanwhile one would be talking of a fully electronic ignition (VZ) because ignition triggering, ignition angle determination and distribution are all accomplished via electronic switches and/or components today. In modern microprocessor controlled electronic-map ignition systems it is that the ignition angle gets optimized dependent on speed and load. Information from many sensors such as the knock sensor, the motor temperature sensor and the throttle position sensor are provided for calculating the optimal ignition point in each case.

Most ignition systems are however based on the inductive principle for generating a high voltage by means of an ignition coil. The so-called high voltage capacitor discharge ignition system is an exception, but has substantially failed to make its way from a technical point of view. This concept also known as thyristor ignition is using a thyristor and a capacitor for pulse generation. An ignition transformer for high voltage generation is also used in practice. This concept, too, is employing a conventional spark plug. A drawback here resides in the fact that the spark duration is only 0.3 ms maximum so that in connection with a classic spark plug there is no guarantee for reliable ignition of the air/fuel mixture.

The basic principle of an ignition system using an ignition coil is a follows: Current from the battery and/or generator flows through the ignition coil primary winding to build up a strong magnetic field for energy storage when the breaker contact is closed with the ignition switch in the ON state. At the ignition point the breaker interrupts the current feed, the magnetic field energy as stored inside the coil attempts to keep up current supply and inside the secondary winding induces the high voltage needed for ignition which gets to the spark plug via coaxial high voltage cables to trigger an arc there. The energy required for this is in the range between 0.2 and 3 mJ. The ignition system carries stored energy to the order of 60 to 120 mJ in practice.

The electric signal getting to the spark plug is a so-called delta pulse under time range aspects. Since in practice the breaker contact cannot be opened infinitely fast either the mechanical or the electronic way and the ignition system (especially the extended ignition coil) is not capable of transmitting signals far into the GHz range, the signal involved here is a low pass limited signal. This means that the time signal has the characteristic of an SI pulse which is based on the function sin(x)/x. When considered under frequency range aspects, an ignition pulse has a very broad spectrum that theoretically starts at 0 Hz and in practice increases to higher frequencies in the three-digit MHz range and strongly decreases in the GHz range.

To sum up it is an objective by means of optimal ignition to achieve optimization in the sense of bringing up the engine to maximum power and/or securing minimum fuel consumption and/or obtaining exhaust gas purity while at the same time avoiding engine knocking.

Responsible for this in the end are the position, the form (length) and the duration of the arc on the spark plug. It is due to the electronic-map ignition now that the arc point precisely controllable while the other three parameters are substantially dependent on the configuration of the spark plugs and also on the architecture and the capability of the ignition system.

So-called ignition chambers or two spark plugs in the cylinder head are occasionally adopted to improve the configuration of the spark plug and/or combustion. The longer the distance between spark plug electrode and ground is the longer will be the ignition spark also. Provision of several ground arches on a spark plug permits to implement several spark gaps. One would maximize spark length and number of sparks to optimize combustion. This requires a higher voltage and power within the ignition system.

The ignition spark ignites the air/fuel mixture. The spark duration is substantially determined by the flame propagation (combustion rate) $v_M$. The combustion rate $v_s$ is between 20 and 40 m/s. This means that the time for one combustion process $t_s$ referred to a cylinder radius r, of 5 cm is about 25 ms. Advantageous in the sense of low fuel consumption and hence high efficacy is a short spark duration and (relative to the piston movement) a correct timing of heat liberation which latter may be optimized by electronic-map ignition including knock sensors.

Apart from this 'classic' state of art there is also a first paper already that goes in the direction of the HF ignition hereinbefore presented, namely [3] A Novel Spark Plug for Improved Ignition in Engines with Gasoline Direct Injection (GDI)' by Linkenheil et al, IEEE Transactions on Plasma Science, Vol 33, No. 5, October 2005). This paper describes in detail the reasons why a classic injection system fails to produce adequate results in the case of gasoline direct injection engines. To overcome the problems there is a design proposed which provides for an inner conductor of a coaxial resonator to protrude into the cylinder space.

It is clearly being described under [3] also that plasma generation in increasingly compressed air such as in gasoline engines is requiring an increase of electric field strength.

Critical Aspects of Prior Art

Most of today's ignition systems are operating with an inductive ignition system (ignition coil) and one spark plug (for each cylinder).

The ignition spark(s) on the only one spark plug per cylinder is (are) disposed in the center of the cylinder. Spark duration is dependent on the cylinder radius. Modern engines are of short stroke design and for this reason have a relatively large cylinder radius. Efforts to improve the design of conventional spark plugs have not yet succeeded in creating an arc range that would be capable of reducing the spark duration by factors. If spark duration could be shortened to one third of what is customary at present it would be practicable to achieve a marked improvement of efficacy to thereby get to lower fuel consumption and/or higher capacity yield.

The ignition system operates with extremely high voltages which factor in particular inhibits to achieve a high degree of integration of the system and also requires a very great deal of effort and expense to develop system component parts made from top-quality materials.

Voltage insulation is one of several reasons why an ignition system is not configured strictly to high-frequency aspects (i.e. in an impedance-controlled way). This missing high-frequency suitability in turn calls for use of a higher voltage.

The ignition spark and/or arc as generated extends completely from the electrode right up to ground. Ionization of the gas (air/fuel mixture) takes place within a narrow space. It is via this ionized path that a short-time current of very high density flows. This punctually high current density tends to cause heavy wear to the spark plugs. Though evermore improved and expensive materials have been used especially for the electrode the service life of a spark plug is limited to between 50000 and 80000 km. Consequently, spark plugs need to be replaced quite frequently which causes higher and higher expenses particularly where modern ultracompact engines are concerned.

The ignition system if of relatively low efficacy. An essentially improved efficacy not only would reduce current consumption, but also involves substantially less power loss in the form of heat dissipation which in turn permits to achieve a design which is less expensive and which offers a higher degree of integration.

For high frequency ionization to be achieved it is necessary to have a substantially high electric field strength which ought to be generated from as little power as possible. According to the solution proposed under [3] there is no impedance transformation taking place in the feed line to the resonator which (as will be described hereinafter) would be detrimental to generation of a high-strength field. The concept of having an additional resonator protrude into the cylinder is not in conformity with what is current practice either. Alternative resonator configurations will be presented in the following.

In addition has the effect of varying resonance frequency not been taken into consideration here (will as well be described hereinafter). An inadequate description of the resonator's loaded quality as well as the missing of a three-dimensional field simulation are further factors that are contributing to an inadequate high-frequency output yield. Seen as a whole, this approach has led to a solution that requires a peak power of about 600 W for plasma generation in the motor vehicle engine and can hence be carried into effect with a great deal of effort and expense only.

All prior known ignition systems are employing a metallic electrode which needs to have a good thermal bond to the cylinder head in order to prevent excessive heat-up and melting thereof. Such a good heat dissipation results in a marked reduction of an ignition system's efficacy.

Achievable Benefits

This present invention relates to creating an ignition system which is based on a relatively narrow-banded high-frequency signal (in the three-digit MHz range and throughout the entire GHz range) as well as a broad and almost optionally designed arc range (ignition range) which is not extending to ground and whose spark duration (duration of ignition) is selectively adjustable. The spark plug still comprises one single electrode of optional design. Cylinder head and piston are forming the ground.

This high-frequency ignition system permits to create a type of spark plug which for instance comprises one double electrode and consequently have two ignition spark paths. It is possible even to provide the electrode in form of a ring (torus) whose radius is ⅔ that of the cylinder. Gas ionization is only around said ring. Arcs are generated around the entire ring which do not extend to ground (cylinder head or piston) and whose lengths are in the centimeter range. It is by means of that ignition spark that at equal combustion rate or velocity the spark duration can be reduced to one third. The duration of spark ignition is now adjustable. This brings about a marked improvement of engine efficacy. Since the spark is in the centimeter range it is possible to have the spark duration substantially reduced even further due to the shorter paths.

The higher the frequency of the ignition signal will be selected, the lower can be the voltage applied to the spark plug. In the lower GHz range already for which a large number of low-priced electronic components are available it is practicable dependent on the arc length desired in each case to reduce the voltage to one-digit kV values at maximum. This reduction of maximum voltage enables the invention to be carried into effect with materials and components whose costs are substantially lower.

The fact that just one and/or two narrow-banded high-frequency signals may be used it is very easy to provide a design which is suitable for high-frequency operation. Lambda/2 lines with all of their benefits may now be used for instance which means that the lines need not to have a desired wave impedance any longer. This makes it easier to design a spark plug which is for instance suitable for high-frequency use.

The electrode now radiates energy over several paths or a large area. The electromagnetic energy generates a high-frequency current around the electrode within the ionized region which due to heat-up is caused in an arc mode to give off radiation energy in the optical range. Energy emission from the electrode is hence no longer in the form of a current, but of an electromagnetic field. The electrode is not loaded by the spark (field) any more so that no special metal is needed for the electrode. The spark plug may hence be used for as long as the entire life of the motor vehicle.

In an effort to minimize turbulences in particular it is possible to design the electrode to have a cylindrical shape and similar to a classic spark plug to just slightly protrude into the cylinder space. Other than in case of a conventional spark plug, however, any ground electrode that is chiefly responsible for turbulences is omitted.

Highly integrated and lowest cost high-frequency power amplifiers for use in GSM mobile communication systems and handsets have efficacies of more than 50%. Short lines may be implemented with substantially no losses in the GHz range. It is hence practicable for a high-frequency ignition system to ensure a very good efficacy and hence highly integrated design solutions.

In contrast to what is being described under [3] the cylinder space is either wholly or in part forming the high-frequency resonator. This avoids effort and expense and permits to keep the combustion chamber substantially unchanged. Spark plug design, too, is substantially easier and similar to that of a conventional spark plug, thus offering a lot of practical benefits. Impedance transformers moreover create a markedly higher field strength which compared to [3] helps to substantially bring down the necessary high-frequency outputs. In addition, varying resonance frequencies are followed up.

The materials selected for making electrodes include both metals and dielectric materials. An electrode may for example be composed of a ceramic material having a high dielectric constant and a very high melting point. Very efficient heat dissipation is hence no longer required such that a markedly improved efficacy may be achieved.

SUMMARY OF THE INVENTION

The use of magnets permits the design of the spark gap to be further simplified.

The use of high-frequency ignition systems is not restricted to motor vehicles. Such systems may be adopted in all areas involving ignition processes.

Since electrode design is optional, the high-frequency ignition system may also be used as luminescent media. Especially in connection with gases having low ionization energies can effective luminous advertising means be provided.

High-frequency ignition systems can be used to substitute the starters in fluorescent tubes.

Even for optimization of explosive devices could a high-frequency ignition system be adopted.

The electric field strength needed for ignition may be reduced by means of additional UV radiation.

BRIEF DESCRIPTION OF THE DRAWINGS

Exemplary embodiments of this present invention will now be described with reference to the accompanying drawings in which.

DETAILED DESCRIPTION OF THE INVENTION

Fundamental Principles of High-Frequency Ionization

Figure 1:
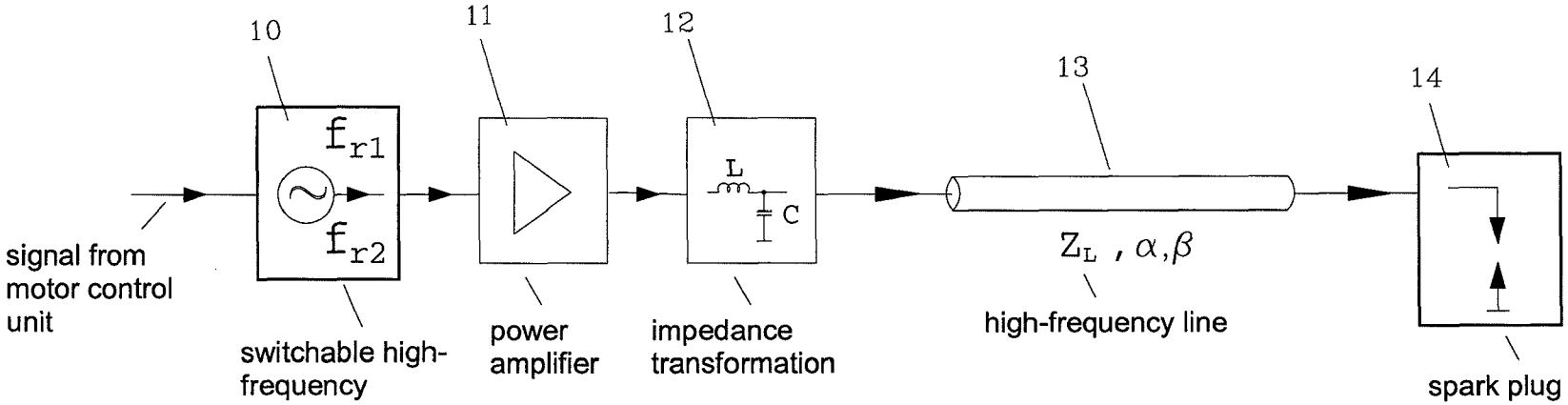
FIG. 1 is a block diagram of an ignition system for one cylinder according to this present invention.

Publications on fundamental physical principles are teaching that ionization of a gas only takes place by electron impact ionization as initiated by electron beam bombardment, thermal ionization at extremely high temperatures (106K) or photoionization by means of ultraviolet light.

In addition the inventor developed physico-experimental setups in the GHz range by means of which ionized areas for infeed of relatively little high-frequency energy have been created. These results are in compliance with other published data which have however been established in the MHz range ([1](Experiments with High Frequency) by H. Chmela, Franzis-Verlag, ISBN 3-7723-5846-2). This will be referred to as high-frequency ionization hereinafter. There are illustrations in [1] of sparks generated by high-frequency ionization which resemble an application as ignition system. This high-frequency ionization is also evidenced in [3] where it is emphasized that using additional UV radiation will enable that ionization to be obtained at lower electric field strengths.

An ionized gas containing an equal number of electrons and ions is a gas that is averagely volume charge free and called plasma.

Maxwell equations further show that the mathematical correlations below apply to a ionized gas:

Relative Dielectric Constant:

$$e_r=1-(Ne^2)/e_0/m/(u^2+w^2) \quad (1)$$

Relative Conductance:

$$k=(Ne^2u)/m/(u^2+w^2) \quad (2)$$

Plasma Frequency:

$$wp=e(ne^2/m/e_0) \quad (3)$$

wherein:

N: number of electrons each volume

E: charge of one electron m: mass of one electron $e_0$: electric field constant u: frequency of electron collisions with gas molecules w: frequency of high-frequency signal Detailed investigations show that below the plasma frequency there is no electromagnetic energy that is enabled to spread and that there are no losses in plasma involved. On the other hand does the space above plasma frequency exhibit a real guide wave impedance Zf. This factor Zf reduces towards higher frequencies exponentially approaches the free space impedance $Z_0$ of about 377 W which means that lower voltages are needed at higher than at lower frequencies to achieve identical performance results.

Equation (2) shows that the (low) impedance and hence the losses tend to augment at increasing frequency. Consequently, heating of the gases is improved at higher frequencies. From an analysis of the atmosphere for high-frequency signal transmission properties it may be seen that radiation is virtually not at all absorbed in the two-digit to three-digit MHz range whereas all of the radiation is damped in hydrogen and/or oxygen by way of molecular absorption at 50 GHz.

So-called Tesla transformers may be adopted in the lower MHz range to therewith provide 100 W generators having an output voltage of 5 kV and to create 10 cm long spark gaps in air, [1]. The inventor hereto has already managed to generate 1 cm long spark gaps at 2.5 GHz using a 50 W transmitter and a voltage of only 300 V. The power draw in that case was far below 50 W. Any circuitry optimization has not been made.

The inventor hereto also describes how to implement by means of components and structural units from the high-frequency electronics mass market a circuit arrangement that is apt for ignition signal generation and what the design of a related spark plug should be like.

Basic Design and Arrangement

This present invention relates to the design and arrangement of an ignition system which is based on a relatively narrow-banded high-frequency signal (in the three-digit MHz and the entire GHz range) and a vast arc region of virtually optional design which does not extend up to ground. The ignition system (in short called ignition) can be broken down into an ignition signal generating section and the spark plug. The spark plug still comprises just one electrode of nearly optional design. Cylinder head and piston are forming the ground.

This high-frequency ignition permits to create spark plugs of a type which for instance comprise several spark paths as electrode or even a ring (torus) having a radius that is ⅔ that of the cylinder. The gas gets ionized around said ring only. An arc region is generated around the entire ring, but does not extend right up to ground (cylinder head or piston). An example in this regard is described in [1]. Spark plugs of such design will be referred to as LC resonator spark plugs (in short LCR spark plugs). A so-called TEM mode for the high-frequency signal is adopted for this ignition process.

A further modification of this present invention provides for the ignition sparks to no longer spread towards ground, but to propagate parallel to the two ground faces (cylinder head and piston). Spark plugs of that design will be referred to as cavity resonator spark plugs (in short HR spark plugs). A so-called cavity resonator mode is adopted for this ignition process.

Since the high-frequency ignition system is of very simple design and well-priced it is being assumed that a separate system can be used for each of the cylinders. The high-frequency electronics of that system are arranged at the end of the spark plug connector in that case. Needless to say that the invention may be modified to the effect also that there is only one circuit arrangement for spark generation and that the energy is distributed. The steps taken for this while using electronic PIN diodes or transistor switches are known in the art and components adapted for use in this conjunction can be manufactured.

Special forms of the two spark plug types mentioned above are obtained when using dielectric electrodes whose use in the GHz range is quite easy.

Design of Ignition Signal Generating System

Irrespective of which of the spark plug concepts may here be adopted there is no ionized mixture path or area yet at the beginning of an ignition process. Fact is that in such an initial state the spark plug is having the effect of a low capacity means and/or a long resonator section while immediately after ionization (and ignition) the capacity will increase and/or the resonator section will shorten. Consequently, the resonance frequency $f_r$ will vary after ignition has taken place. This is very significant especially for a system comprising the LCR spark plug.

It is for this reason that after ignition the ignition signal generating system must be enabled to perform a fast non-recurrent frequency hop from $f_{r1}$ to $f_{r2}$. It is important in this conjunction that the output impedance $Z_{aus}$ of the ignition signal generating system conforms and/or is complex conjugate to the input impedance $Z_{ein}$ of the spark plug after ignition.

This frequency hopping is accomplishable with the aid of either a voltage controlled oscillator (VCO) or by fast electronic changeover between two solid-state oscillators.

Since VCOs for a lower GHz range are available as extremely low-priced modules these may be given the preference. This necessary component is generally represented as a switchable oscillator 10 in FIG. 1 which is controlled by the engine control system. The output signal from the oscillator which is typically in the mW range is raised into the one-digit to two-digit W range by means of a power amplifier 11. Highly integrated electronic power amplifiers in the low one-digit GHz range are featured by efficacies far above 50% and are extremely well priced and hence predestined for use.

An impedance transformation 12 is effected to provide as high a voltage as possible on the spark plug 14. A very vast range of circuit arrangements are here available for high frequency application. The lowest-price circuit arrangement consists of capacitors and coils (multistage gamma transformer) and is discussed in 'Hochfrequenztechnik' (High-frequency Technology) by H. Heuermann, Vieweg-Verlag, ISBN 3-528-03980-9, [2]. The output impedance $Z_{aus}$ should preferably be in the three-digit Ohm or in the one-digit kOhm range.

The voltage on the spark plug is calculated direct from the amplifier output power $P_{out}$ and $Z_{aus}$:

$$U=e(P_{out}Z_{aus}) \tag{4}$$

An operating point should hence be selected which is clearly above the plasma frequency wp. The high-frequency line 13 (coaxial line for instance) that follows should preferably be rated with the characteristic wave impedance $Z_L=Z_{aus}$. It is not absolutely necessary for it to conform to the characteristic wave impedance $Z_L$ of the output impedance when there is ensured that the line corresponds to the length of n*lambda/2 at both of the resonance frequencies $f_{r1}$ and $f_{r2}$. The highest-impedance and lowest-price coaxial line is obtained when the ignition system integrated in the spark plug connector is connected to the spark plug via the inner conductor (of the coaxial line) only. The outer conductor is in that case constituted by the cylinder head and/or valve cover. The kOhm range is normally not yet reached even with this arrangement.

Another remedy would be to integrate a second impedance transformer into the spark plug.

Alternatively and with just little extra expense can the entire circuit arrangement be provided in differential integrated circuit design (2). In that case, a markedly higher-impedance high-frequency line may for instance be obtained with a two-wire line arrangement. It would however be more advantageous to use two spark plugs of identical design. This symmetrical technology would be particularly advantageous for activating the HR spark plugs shown in FIG. 6.

The LC Resonator Spark Plug

Figure 2:
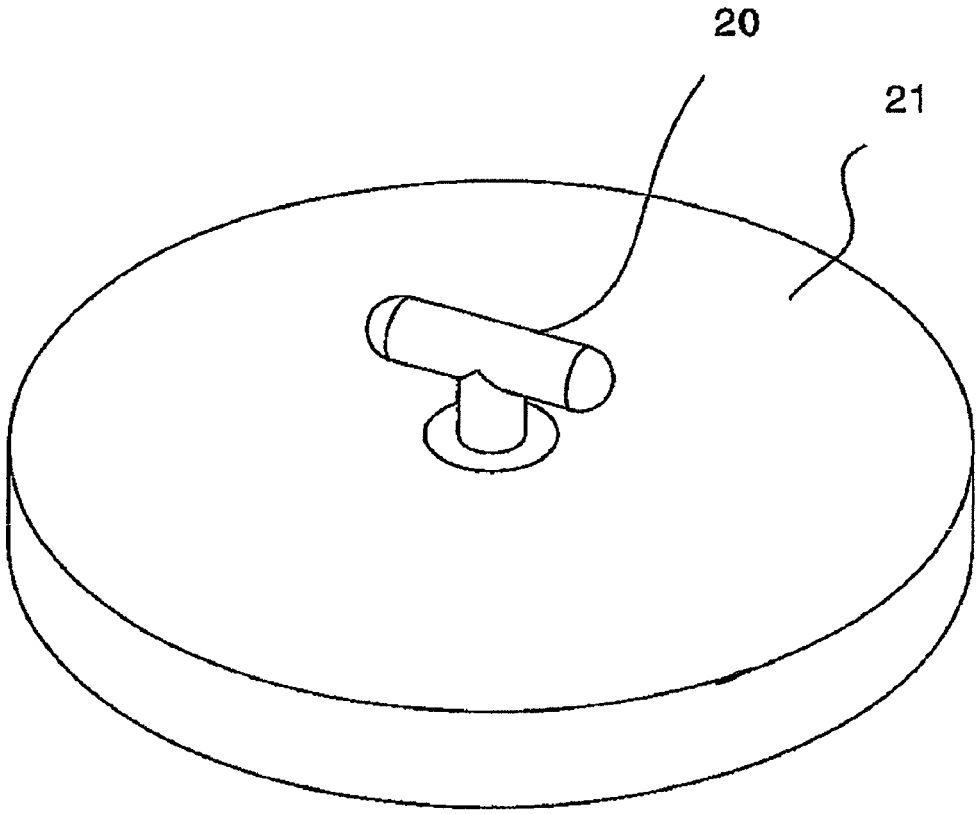
FIG. 2 represents a T-shaped resonator spark plug disposed above a cylinder head for generation of two ignition sparks.

An LCR spark plug 20 of simple design is shown in FIG. 2. Similarity with a classic spark plug without ground electrode is evident. In case of an LCR spark plug now it is the piston and the cylinder head 21 that serve as ground. The electrode, if metallic, is connected to ground in the lower invisible area. The electrode is somewhat closer to the cylinder head in practice than the piston is. In this case there are two spark gaps provided which extend from the two ends of the electrode towards the cylinder head. Two separate bow-shaped connectors may be used instead of just one tee. This arrangement would ensure that there are two ignition sparks at all time.

Figure 3:
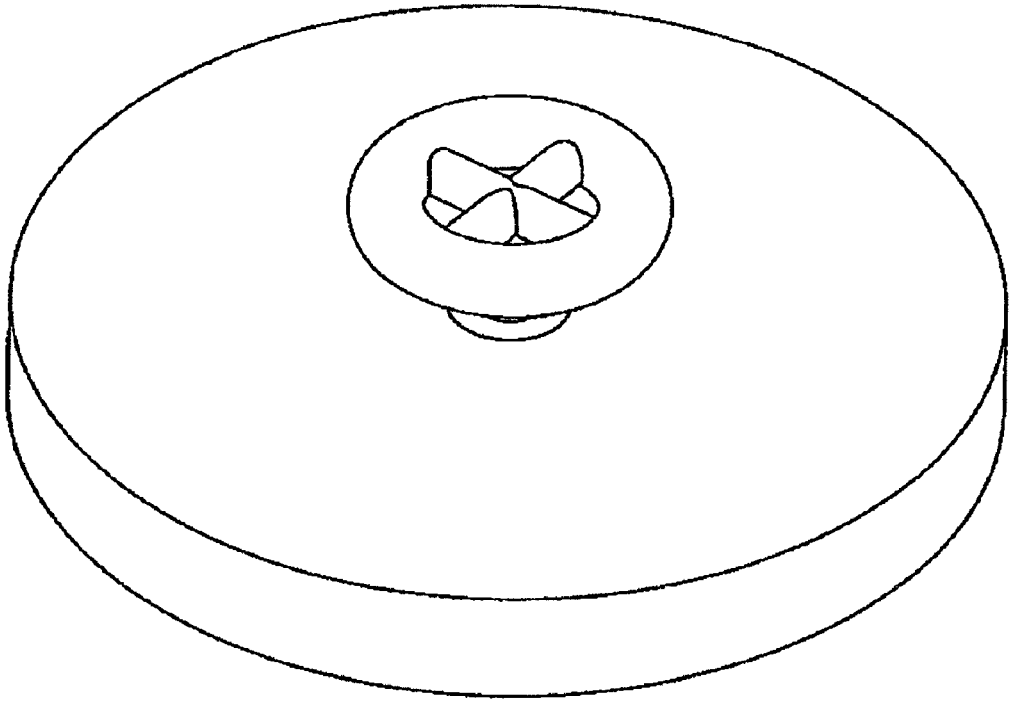
FIG. 3 shows a toroidal LC resonator spark plug arranged above a cylinder head.

The tee may be extended into a double tee or even more complex fittings. Another potential embodiment of an LCR spark plug is shown in FIG. 3. Its resemblance with the experimental setup according to [1] electrode design aspects is obvious. Embodiments comprising an increasing number of ignition paths are affected by the drawback that heatup tends to reduce around each of these paths so that ignition of the air/fuel mixture might become unlikely. This drawback may be overcome by a marked increase of high-frequency energy as fed.

The TEM mode is used as high-frequency waveguide in case of this spark plug [2]. In consequence, this concept may be applied across a rather large frequency range in the MHz and the lower GHz field. This concept comes up against its limits when cavity resonance modes are for first time occurring.

The LCR spark plug is a reproduction of an LC resonator which means that the metallic electrode is reproducing an inductance (L) and the air gap between electrode and/or spark end and ground is reproducing a capacitance (C). The spark gap is to be regarded as an ohmic resistance (consumer) in a first approximation. Consequently is the capacitance distinctly lower in the non-ignited than in the ignited state. This results in the two different resonance frequencies for this LC series oscillating circuit. Optimization of the series oscillating circuit requires that the inductance be selected as high and the capacitance as low as ever possible which substantially promotes a large electrode to ground distance as desired.

The geometry of the electrode has an influence on the ignition spark range and the resultant input impedance $Z_{ein}$ of the spark plug, though said latter may get strongly varied by coupling the high-frequency signal to the electrode. Publication [2] as well as other standard literature are giving many examples of how an LC oscillation circuit can be coupled. Issues of interest here are the current coupling as well as the magnetic coupling which may comprise additional impedance transformation. In case of current coupling it is that the inner conductor of the high-frequency line 13 is direct coupled to the electrode with a short circuit distance x of some millimeters or centimeters from ground. Selection of said distance x strongly varies the coupling k and the input impedance $Z_{ein}$. In case of magnetic coupling on the other hand is a ground connected second inductance installed in direct vicinity of the electrode (within the invisible region, FIG. 3) and connected to the inner conductor of line 13. Dependent on the inductances as selected it is practicable with this circuit arrangement to create an additional and normally wanted voltage transformation.

3D high-frequency field simulators permit to represent the electromagnetic fields inside the cylinders. Regions having the highest electric field strengths are those in which the ignition spark is propagating.

Symmetrical circuit arrangements offering a number of advantages are adopted in high-frequency technology to an ever increasing extent. A most comprehensive description of this type of circuit arrangement is given In [2]. Use in an ignition system on the one hand offers the electric circuit benefits as described in [2] right up to compensation of the Miller effect while voltage doubling directly results on the other hand, it being possible also to provide higher-impedance lines for use in an ignition system. In addition there is a major advantage obtained to the effect that by now adopting at least two spark plugs it is possible to provide spark regions that extend strictly parallel to the ground faces. The ground has a 0V potential and the spark regions still develop between the two electrodes only.

The Cavity Resonator Spark Plug

Figure 4:
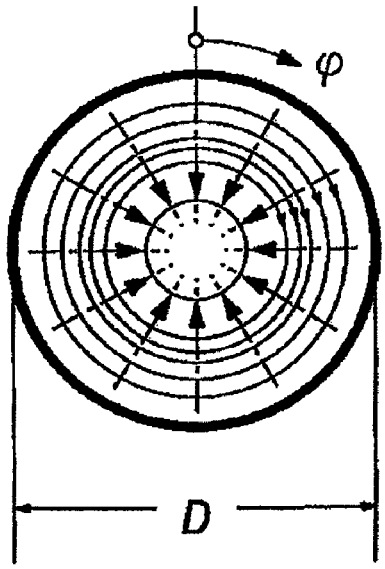
FIG. 4 is a representation of the $E_{01}$ mode in a circular wave guide (E-field in dash line and H-field in solid line representation)

Cavity modes have been investigated in depth both scientifically and technically and implemented in many components such as high-frequency filters. These modes may exist off a certain lower cutoff frequency. They are preferably used in technical applications because losses in the metal are very low. FIG. 4 represents a potential cavity mode ($E_{01}$) which is very interesting for implementation in an ignition system because the electric field is optimally shaped. There are flux lines only inside the relatively shallow cylinder chamber so that sparks are just spreading parallel to the ground faces. These ignition sparks also form a ring which ensures minimized spark duration.

Figure 5:
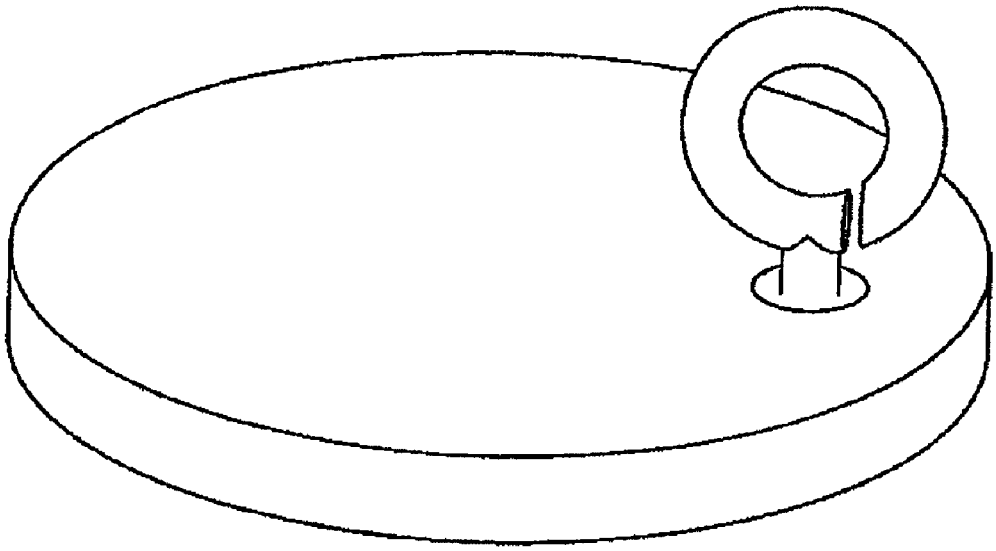
FIG. 5 is a perspective view of a cavity resonator spark plug disposed above a cylinder head (without valves) for exciting the $E_{01}$ mode under conditions of unsymmetrical excitation.
Figure 6:
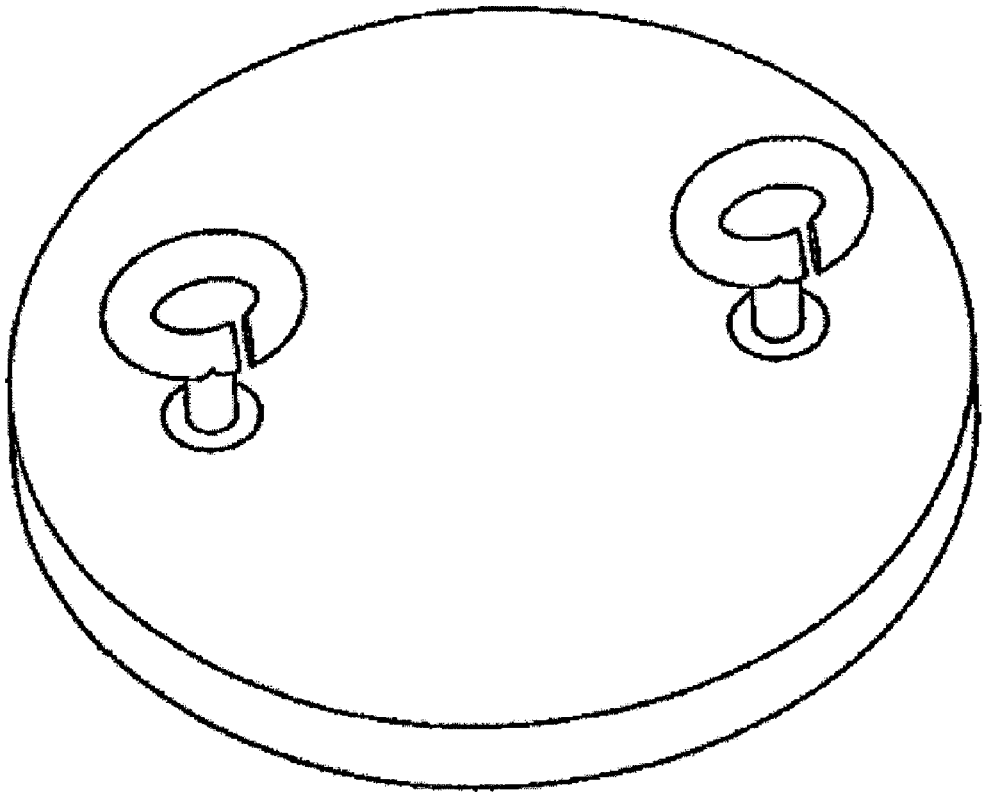
FIG. 6 is a perspective view of a cavity resonator spark plug (without valves) disposed above a cylinder head for exciting the $E_{01}$ mode under conditions of symmetrical excitation.

One possible embodiment of an HR spark plug for excitation of the $E_{C1}$ mode is illustrated in FIG. 5. FIG. 6 shows an arrangement for a case in which the ignition system is provided in symmetrical circuit design. Excitation of the magnetic field is via loop in both cases. The symmetrical solution inhibits the occurrence of other unwanted cavity modes even much better than the unsymmetrical solution does. This means that the HR spark plug is just a coupling element still for the resonator which is formed by the boundaries of the metallic faces. The adjustable coupling k in turn permits to accomplish a voltage transformation which is in [2] represented as gamma transformation that tends to slightly tune off the resonance frequency. Band width tends to decrease as the transformation value increases.

In the case here referred to of the $E_{01}$ mode the ignition sparks are inside the cavity only and contacting neither coupling loops nor ground. The spark gaps are to be regarded as ohmic resistors (consummers) in a first approximation which "reduce" the reactive resonator region so that frequency hopping may be useful here.

Mode selection and geometric configuration of the electrode have an influence on the ignition spark range and the resultant input impedance $Z_{ein}$ of the spark plug.

Where a high-frequency ignition system is to be used in a direct injection gasoline engine (GDI, see [3]) the basic mode $H_{12}$ would provide a reasonable solution for the HR spark plug. This basic mode offers the very essential advantage that there is only one frequency range in which it occurs. This fact makes coupling substantially easier. A benefit offered by that HR spark plug over and above [3] would reside in the fact that in addition to the improvement earlier described an ignition would not be taking place in just one point, but along the full circumference around the air/fuel mixture jet as injected.

The Dielectric Electrode

The spark plug designs so far described herein have referred to the exclusive use of a metallic electrode. A very advantageous modification of this present invention provides for use of a strictly dielectric electrode or a combination consisting of a metallic core and a dielectric sheath in place of the metallic electrode. When using only a dielectric medium (having a relatively high dielectric constant) as an electrode, then one would speak of a dielectric wire and/or resonator in high-frequency technology. The $HE_{11}$ hybrid basic mode is preferably selected as line mode in case of wire use. The resonator also adopts further lower-loss modes dependent on the type of coupling provided. A Goubau type surface conductor (also called Goubau-Harms conductor) is formed when using a combination electrode consisting of a metallic core and a dielectric sheath which enables very low-loss transmission in the region from the two-digit MHZ to the GHz range.

Figure 7:
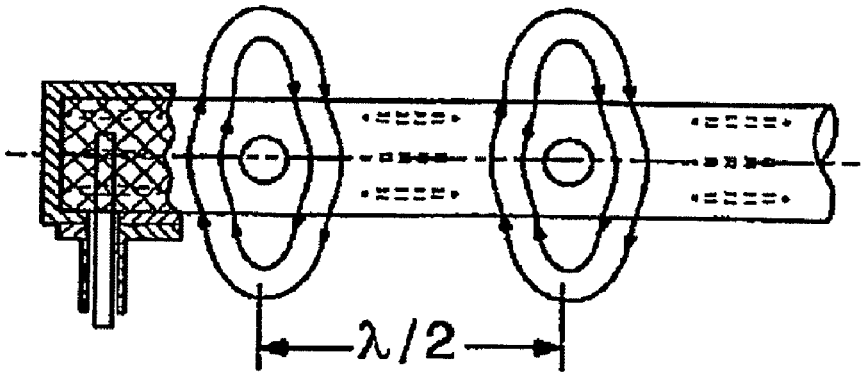
FIG. 7 shows a type of coupling of a dielectric electrode for exciting the $HE_{11}$ basic model.
Figure 8:
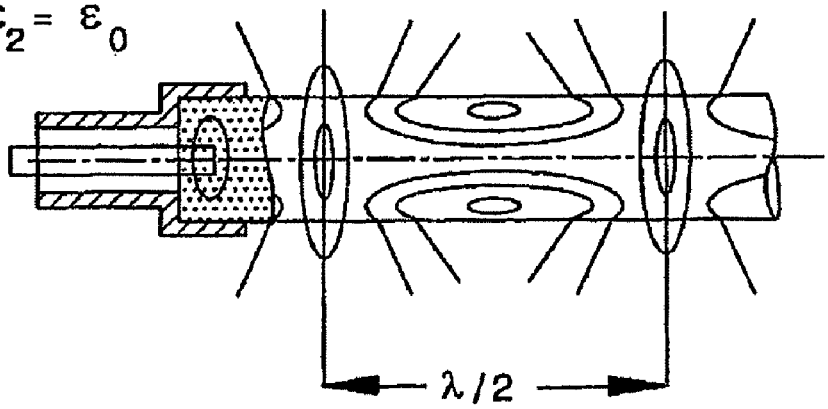
FIG. 8 reflects a type of coupling of a dielectric electrode for exciting the $E_{01}$ mode.

These two arrangements (generally referred to as dielectric electrodes) may be employed in place of metallic electrodes and/or coupling elements in which case the coupling structure of line 13 inside the spark plug 13 is modified. A large number of mechanical arrangements is applicable dependent on the high-frequency mode from case to case required. One example of basic mode excitation (enabled to propagate from 0 Hz) is shown in FIG. 7. Another example for excitation of the $E_{01}$ mode as illustrated in FIG. 8 can be very advantageously implemented.

Figure 9:
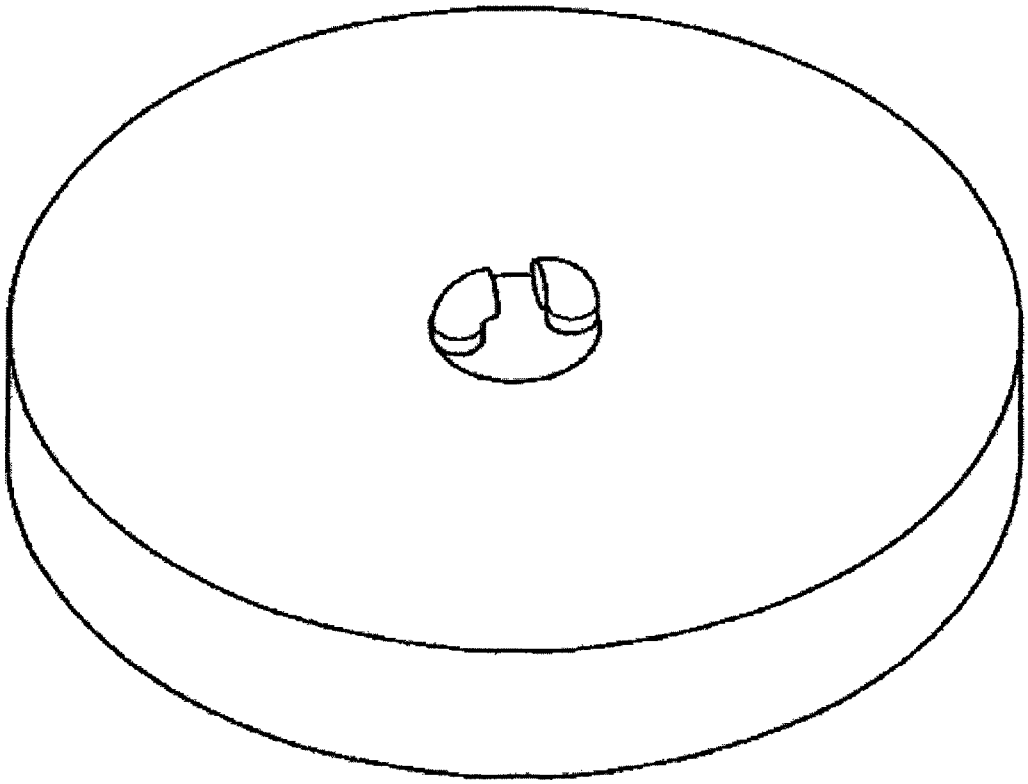
FIG. 9 shows a TEM or dielectric spark plug (without valves) disposed above a cylinder head for spark generation under conditions of symmetrical triggering.

As earlier mentioned, the dielectric electrode may be used in place of an LC and HR spark plug. There is no change of waveguide mode in case of the HR spark plug except that the geometric form of the dielectric wire will require optimization to suit given coupling conditions. This means that from a coaxial mode there is a changeover to the dielectric conductor mode and finally to the circular waveguide mode. Somewhat different is the situation in case of the LC spark plug where a change would be less perspective. FIG. 9 for instance shows an arrangement that can be implemented with strictly metallic, with mixed or with strictly dielectric electrode materials.

The version shown in FIG. 9 in both cases produces an ignition spark that extends between the two electrodes. This arrangement is an advantageous modification of the high-frequency ignition system used for direct injection engines.

Determination of Input Impedance Zein 3D high-frequency simulators permit the calculation of the electromagnetic field and the input impedance $Z'_{ein}$ before the ignition point. It goes without saying that simulators fail to account for high-frequency ionization and ignition. When the va-rying input impedance $Z_{ein}$ after ignition is to be determined, then this can be done by what is called a hot scatter parameter measurement which is known from the field of measuring electric properties of power amplifiers.

Shape of High-Frequency Signal

Optimizations over and above a strictly sinusoidal design are possible of a high-frequency signal. Plasma may be much better produced for instance when a signal is a so-called chirp signal whose absolute frequency varies with time. Same as known from radar technology must the transmission path be rated with reasonable dispersive power. A correctly designed arrangement will after passing the transmission path generate a pulse of delta signal shape of markedly increased electric field strength. Since in practice it is after ignition with a high-frequency pulse as short as this to maintain the ignition spark for a predetermined length of time, a fixed frequency is kept up for such desired duration after the frequency sweep.

Use of a Dual-Mode Resonator

In addition to the measures hereinbefore described to increase electric field strength there has been another method described just a short time ago, [4], 'Resonatorsystem and Verfahren zur Erhöhung der belasteten Güte eines Schwingkreises' (Resonator System and Method for Increasing the Loaded Quality of an Oscillating Circuit) by Heuermann, H., Sadeghfam, A., Lünebach, M., Patent D102004054443.3, Nov. 16, 2004. An increase of resonator voltage is achievable only by improving the loaded quality. [4] is presenting a large number of circuit arrangement solutions which may also be availed of in this here conjunction.

The invention claimed is:

1. A high-frequency ignition system for generating ignition sparks inside a metal sheathed cavity using a high-frequency signal in the MHz or GHz range, said system comprising:

an oscillator for generating the high-frequency signal in the MHz or GHz range;

a power amplifier to increase the power of said high-frequency signal; and means to increase a voltage of said high-frequency signal with at least one impedance transformer, wherein ignition is achieved by at least one single spark plug having one electrode, wherein at least one spark region is provided around said electrode which covers up at least one path, wherein the ignition spark region does not extending up to ground; and wherein the high-frequency signal propagates in at least one high-frequency mode inside the ignition chamber.

2. The high frequency ignition system according to claim 1, wherein:

a. the high-frequency signal inside the ignition chamber is a TEM mode;

b. the circuit arrangement is of unsymmetrical type and only one spark plug is used; and c. the electrode of the spark plug is connected to ground by one of its ends and by its other end protrudes into the cylinder and is connected to the ignition system by electric coupling.

3. The high frequency ignition system according to claim 1 wherein:

a. the high-frequency signal inside the ignition chamber is a TEM mode;

b. the circuit arrangement is of symmetrical type and two spark plugs are used; and c. the electrodes of the spark plug are connected to ground by one of their ends and by their other ends protrude into the cylinder and are connected to the ignition system by electric coupling.

4. The high frequency ignition system according to claim 1, wherein:

a. the high-frequency signal inside the ignition chamber is a TEM mode;

b. the circuit arrangement is of unsymmetrical type and only one spark plug is used; and c. the electrode of the spark plug is open circuit arranged on one of its ends and by its other end protrudes into the cylinder and is connected to the ignition system by electric coupling.

5. The high frequency ignition system according to claim 1, wherein:

a. the high-frequency signal inside the ignition chamber is a TEM mode;

b. the circuit arrangement is of symmetrical type and two spark plugs are used; and c. the electrodes of the spark plugs are connected to ground by one of their ends and by their other ends protrude into the cylinder and are connected to the ignition system by electric coupling.

6. The high frequency ignition system according to claim 1, wherein:

a. the high-frequency signal inside the ignition chamber is a circular waveguide mode and that the associated frequency is selected of such magnitude as to enable the mode to exist;

b. the circuit arrangement is of unsymmetrical type and only one spark plug is used; and c. the (metallic and/or dielectric) electrode of the spark plug inside the cavity is having the functionality of an electric or magnetic coupling element and is direct connected to the ignition system via insulation.

7. The high frequency ignition system according to claim 1, wherein:

a. the high-frequency signal inside the ignition chamber is a circular waveguide mode and the associated frequency is selected of such magnitude as to enable the mode to exist;

b. the circuit arrangement is of symmetrical type and two spark plugs are used; and c. the (metallic and/or dielectric) electrode of the spark plug inside the cavity is having the functionality of electric or magnetic coupling elements and is direct connected to the ignition system by insulation.

8. The high frequency ignition system according to claim 1, wherein:

a. the high-frequency signal inside the ignition chamber is a mode of a dielectric waveguide;

b. the circuit arrangement is of unsymmetrical type and only one spark plug is used;

c. the electrode is made of a merely dielectric material or a dielectric material with metallic core; and d. the electrode of the spark plug is connected to ground by one of its ends and by its other end protrudes into the cylinder and is embedded into an insulation including a dielectric material having a lower dielectric constant as well as connected to the ignition system by electromagnetic coupling.

9. The high frequency ignition system according to claim 1, wherein: a. the high-frequency signal inside the ignition chamber is a mode of a dielectric waveguide;

b. the circuit arrangement is of symmetrical type and two spark plugs are used;

c. the electrode is made of a mere dielectric material or a dielectric material with metallic core; and d. the electrodes of the spark plug are connected to ground by one of their ends and by their other ends protrude into the cylinder and are embedded into an insulation including a dielectric material having a lower dielectric constant as well as connected to the ignition system by electromagnetic coupling.

10. The high frequency ignition system according to claim 1, wherein the high frequency signal is monofrequent.

11. The high frequency ignition system according to claim 1, wherein the high frequency signal is modulated.

12. The high frequency ignition system according to claim 1, wherein the high frequency system is continuous.

13. The high frequency ignition system according to claim 1, further comprising an impedance transformation integrated into the spark plug.

14. The high frequency ignition system according to claim 1, further comprising:

a spark plug connector; and a coaxial line extending between the spark plug and spark plug connector.

15. The high frequency ignition system according to claim 1, wherein the spark plug is a LC resonator having a inductance and a capacitance.

* * * * *